US006601517B1

(12) United States Patent
Guirguis

(10) Patent No.: US 6,601,517 B1
(45) Date of Patent: Aug. 5, 2003

(54) SUPER-CAVITATING PENETRATOR WARHEAD

(75) Inventor: Raafat H. Guirguis, Fairfax, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 67 days.

(21) Appl. No.: 09/985,962

(22) Filed: Oct. 31, 2001

(51) Int. Cl.[7] ..... F42B 12/22; F42B 12/08

(52) U.S. Cl. ..... 102/473; 102/399; 102/478; 102/517; 102/519

(58) Field of Search ..... 102/478, 479, 102/473, 398, 399, 517–519; 114/20.1

(56) References Cited

U.S. PATENT DOCUMENTS

| | | | | | |
|---|---|---|---|---|---|
| 622,479 | A | * | 4/1899 | Isham | 102/478 |
| 1,294,605 | A | * | 2/1919 | Berentsen | 102/399 |
| 3,572,250 | A | * | 3/1971 | Kriesel et al. | 102/399 |
| 4,488,487 | A | * | 12/1984 | Croizer | 102/473 |
| 4,615,272 | A | * | 10/1986 | Aubert | 102/479 |
| 4,967,666 | A | | 11/1990 | Kellner et al. | 102/476 |
| 5,526,752 | A | | 6/1996 | Dahl et al. | 102/517 |
| 5,698,814 | A | * | 12/1997 | Parsons et al. | 102/478 |
| 5,780,766 | A | | 7/1998 | Schroppel | 102/372 |
| 5,929,370 | A | * | 7/1999 | Brown et al. | 102/399 |
| 5,939,662 | A | | 8/1999 | Bootes et al. | 102/473 |
| 6,186,072 | B1 | * | 2/2001 | Hickerson, Jr. et al. | 102/518 |
| 6,283,036 | B1 | | 9/2001 | Munsinger | 102/479 |
| H2025 | H | * | 6/2002 | Munsinger | 102/479 |
| 6,405,653 | B1 | * | 6/2002 | Miskelly | 102/374 |

* cited by examiner

*Primary Examiner*—Harold J. Tudor
(74) *Attorney, Agent, or Firm*—Mark Homer

(57) ABSTRACT

The present invention comprises a warhead for penetrating hardened or buried targets. In general, the invention comprises a warhead for penetrating hardened or buried targets comprising a warhead that employs a super-cavitating nose along with a cellular structural design that uses a reinforced central post as the main load-bearing component and subdivides the explosive cavity into shorter sections. Also, initiation means for initiating the explosives are present.

12 Claims, 1 Drawing Sheet

SUPER-CAVITATING PENETRATOR WARHEAD

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains to warheads and more particularly to warheads capable of penetrating into sand or concrete covered, deeply buried, bunkers without prematurely initiating the warheads' explosive charge, for instance, exploding before reaching living and storage spaces within the bunker.

2. Description of the Related Art Warheads serve many functions related to the attack of area targets. One particular function that is important to attacking an area is the destruction of hard and buried targets such as control centers bunkers buried in sand or covered with concrete as well as targets such as runways in order to immobilize air forces.

Many concepts have been developed to address these types of targets. For example, U.S. Pat. No. 4,967,666 discloses a warhead that uses a forward hollow charge in order to create a passageway for an internal, follow-up projectile to be fired into fortified or armored targets. U.S. Pat. No. 5,780,766 discloses a similar type of "two-stage" device comprising an armor piercing hollow charge that clears a region for the missile to reach its final destination, where upon impact, a post-firing fragmentation explosive charge is released due to inertia. U.S. Pat. No. 5,526,752 discloses a projectile that includes multiple warheads separated by casing with independent detonators wherein the warheads are detonated sequentially in order to penetrate the target. U.S. Pat. No. 5,939,662 discloses a missile warhead comprising a tungsten ballast to provide high warhead sectional pressure upon impact. Finally, U.S. Pat. No. 6,283,036 discloses a variable output warhead comprising several compartments separated by a shock-absorbing shield, each filled with explosive material wherein the shield prevents sympathetic detonation from one compartment to another. Depending upon the target, a specific number of compartments can be selected for initiation.

While these and other designs have provided some success in attacking hardened and deeply buried targets, the inherent trade off between the ability of a warhead to penetrate to a target and the stresses that this penetration places upon the explosive fill within a warhead have proven problematic. Current penetrating warheads are designed so the explosive occupies a single, long and narrow compartment in order to achieve the highest practical sectional density. This design results in significant stresses being placed upon the explosive fill. Such stresses on the explosive fill often cause premature initiation, prior to the completion of the desired penetration, thereby causing failure of the mission. These stresses also cause the outer walls of the warhead to bulge, thereby increasing the tendency of the warhead to buckle under axial loads and rupture. One method of dealing with this latter problem in the past has been to increase the thickness of the outer walls of the warhead. However, when the explosive is finally detonated, a significant amount of the explosive energy is used in fragmenting these thicker outer walls, resulting in low velocity fragments and a weaker blast, i.e., reducing the lethality of the warhead. Therefore, a warhead with improved penetration and explosive potential at the target is necessary in order to more readily complete military critical missions.

SUMMARY OF THE INVENTION

The present invention comprises a warhead for penetrating hardened or buried targets, comprising a super-cavitating nose and a cellular structure for containing explosive material. The cellular structure comprises an outer wall and a plurality of discs that are axially spaced within the cellular structure to form separate cells. There is a central axis approximately through the center of the warhead wherein a load bearing support is located to provide structural support for the cellular structure. Within each cell the explosive material is divided. Finally, initiation means are present to begin the detonation of the explosives.

Accordingly, it is an object of this invention to provide a warhead that increases penetration into hardened or buried targets.

It is a further object of this invention to provide a warhead design that reduces stresses on the explosive material within the warhead while penetrating hardened or deeply buried targets.

It is a further object of this invention to provide for warheads in general, and penetrating warheads in particular, a structural design that is inherently stiff, i.e., resists buckling and deformation at the same or even reduced weight; that exploits the stresses generated within the explosive during penetration to stiffen the load bearing components of the structure even further; and that allows the use of thin outer walls, thus allow more of the explosive energy to be channeled in producing high velocity fragments and a strong blast.

A still further object of this invention is to integrate the different design elements of the warhead such that they all work in concert, enhancing each other's role and performance.

This invention accomplishes these objectives and other needs related to warheads for hardened and buried targets by providing a warhead that employs a super-cavitating nose along with a cellular structural design that uses a reinforced central post as the main load-bearing component and subdivides the explosive cavity into shorter sections.

A super-cavitating nose, by definition, significantly deflects the flow past a projectile or structure travelling at high speed, away from its lateral boundaries, thus reducing the drag on the structure as well as other forces acting at the interface between the flow and the boundaries.

For example, if so equipped, a super-cavitating nose on a torpedo forces the water to flow off the edge of the nose with such speed and at such an angle that the water cannot wrap around the surface of the body of the torpedo. This allows the drag on the torpedo body to be significantly reduced because it is no longer in contact with the water, having a high density, but it is in contact with water vapor, having a low density. This allows the torpedo's velocity to greatly increase due to the overall decrease in friction. The present invention uses a super-cavitating nose design in order to enhance penetration and travel of the warhead through sand, concrete or other impediments between the warhead and the target in a similar manner as that described above. Because the sand and rubble do not come in contact with the body of the warhead and therefore do not exert any forces on the outer walls, they can be made thinner in order to increase the resulting fragment velocity and blast.

The present invention also deviates from the traditional design of aerial (BLU) bombs utilizing thick outer walls and no internal structural support. Instead, the present invention uses a cellular warhead structure with a reinforced central post as the main load-bearing component. In addition to being inherently stiff, this structural design subdivides the explosive cavity into shorter sections. Because the stresses induced in the explosive material during penetration are proportional to the height of the explosive subjected to the deceleration, this reduces the stresses to which the explosive is subjected and the likelihood of premature initiation. Using a central post as the main load-bearing component also allows us to use thinner outer walls, which increases the fragments velocity and blast.

BRIEF DESCRIPTION OF THE DRAWINGS

The accompanying drawing, which is incorporated in and constitute a part of the specification, illustrates an embodiments of the invention, and, together with the description, serve to explain the principles of the invention.

DESCRIPTION OF THE PREFERRED EMBODIMENT

Figure 1:
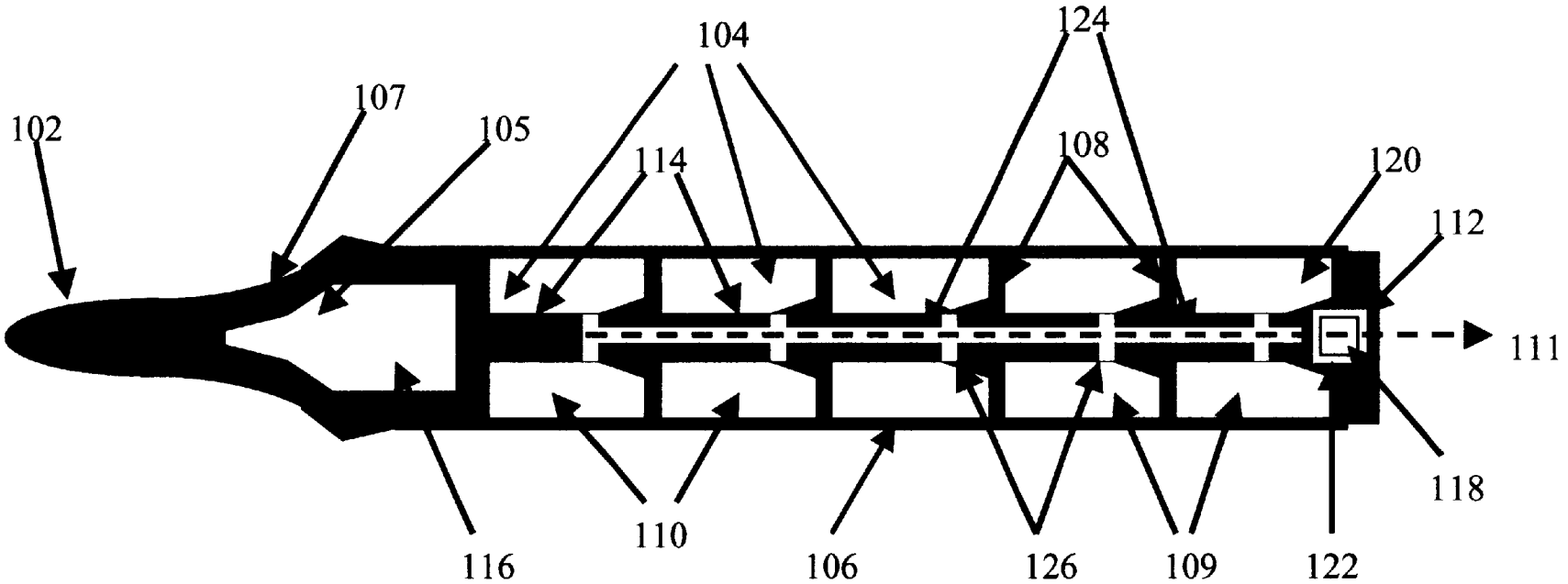
FIG. 1 is a cross-sectional side view of an embodiment of the invention.

The invention, as embodied herein, comprises a warhead for penetrating hardened or buried targets. In the military, this type of warhead is known as a "bunker buster" for its ability to penetrate concrete bunkers or bunkers buried in sand.

A preferred embodiment is illustrated in FIG. 1, but other embodiments containing/satisfying one or more of the following design elements, or the same embodiment in FIG. 1 but with different dimensions and/or different hardness levels are also possible.

Some unique elements of the invention are:

1. A super-cavitating nose that reduces the drag forces and all other forces acting at the interface between sand, rubble, etc., and the outer walls. This increases the penetration capability of the warhead and allows the use of thinner outer walls.
2. A reinforced/thick central post that is the main load bearing component of the structure. This design has several advantages:
   i. In any design, whether the outer walls are thick or thin, the direction of the stresses/pressures generated in the explosive during penetration will be such as to stiffen a central post, making it stronger, but bulge outside walls, weakening them. Thus, there is an advantage to making the central post the main load bearing component.
   ii. Because the outer walls are now thinner, higher fragments velocity can be achieved. The energy of the explosive is not wasted in fragmenting the walls, but, instead, is used in driving the resulting fragments at higher velocity. Thinner walls also allow the use of other options different from fragmentation, such as flying plates, flying swords, EFP's, etc. that can be ejected from the warhead. These are not an option if thick walls are used.
3. Instead of the traditional warhead design which has one long cavity in which the explosive is loaded, a cellular/box structure is used. This is done by incorporating between the central post and outer walls several axially spaced discs that transmit the impact loads of the outer walls and the explosive to the central post. To prevent the discs from shearing (failing in shear mode) and sliding axially around it, the central post is thickened/flared at the base of each disc. This design has several advantages:
   i. The cellular/box structure provides high strength and rigidity at minimum structural weight. The central post and outer walls do not have to be as thick to resist bending and/or buckling. From previous experience it is known that box structures are very efficient (weight wise) in resisting collapse.
   ii. Instead of a single long cavity, the explosive material now occupies several shorter sections, thus reducing the stress to which the explosive is subjected in each section, and enhancing its survivability during penetration.
4. Ballast in a cavity in the nose increases the sectional density of the warhead, thus increasing the penetration capability of the warhead without increasing the forces generated in the main body during penetration.
5. Initiation means in the tail of the warhead, subjected to the least forces during penetration, and distribution lines through the central post that carry the initiation signal/detonation wave to the different explosive compartments.

Referring to FIG. 1, the invention comprises a warhead for penetrating hardened or buried targets, comprising a super-cavitating nose 102 and a cellular structure 104 for containing explosive material 110. The cellular structure comprises an outer wall 106 and a plurality of discs 108 that are axially spaced within the cellular structure to form separate cells 109. There is a central axis 111 approximately through the center of the warhead wherein a load bearing support 114 is located to provide structural support for the cellular structure 104. Within each cell the explosive material 110 is divided. Finally, initiation means 112 are present to begin the detonation of the explosives.

The super-cavitating nose 102 will be shaped to provide super-cavitation to assist in penetration of the warhead as described above. Many shapes can be used to provide part of the super-cavitation and may be selected by one skilled in the art. One preferred shape for the super-cavitating nose 102 is blunt-rounded. The blunt-rounded shape will push the medium that the warhead is penetrating away from the outer walls 106 of the warhead, assisting in the super-cavitating effect. The super-cavitation not only reduces the drag, but also reduces the forces on the outer walls 106, thereby allowing the outer walls 106 to be made thinner. The super-cavitating nose 102 may also comprise an inwardly curved portion forming shoulder 107 to assist in super-cavitation. A preferred embodiment of the invention comprises a nose hardness of from about 55 ksi to about 60 ksi in order to allow for maximum penetration to the target. Many materials can provide this type of hardness and an appropriate material may be selected by one skilled in the art. One example of such a material is steel.

The cellular structure 104 provides for the structure of the warhead. The plurality of discs 108 are axially spaced within the cellular structure 104 to form cells 109. The discs 108 transfer the impact loads from the cellular structure 104 to the load bearing support 114. In a preferred embodiment of the invention the discs 108 comprise a thickness of approximately 1 inch. The cells 109 allow the explosive material 110 to be divided to reduce the load/stresses on the explosive material 110. This occurs because the stress is proportional to the density of the explosive material 110 times the deceleration of the warhead times the height of the explosive material 110. By dividing the explosive material 110, one reduces the height. Reducing the stresses on the explosive material 110 is of particular importance in a warhead that penetrates hardened or buried targets because premature initiation of the explosive material 110 often occurs during such penetration due to the high level of stresses caused by the penetration. The explosive material 110 may be selected by one skilled in the art. Examples of such explosives 110 include HMX based explosives, such as PBXN-110 (88% HMX and 12% HTPB) and PBXW-128 (77% HMX and 23% HTPB).

In a preferred embodiment of the invention, the outer wall 106 is capable of producing high velocity fragments upon initiation of the explosive material 110. This type of design maximizes the use of the explosive potential because the explosive energy is not expended in fragmenting a thick wall. Use of a thinner outer wall 106 would also allow the warhead to project various items that can be used as killing mechanisms from within the warhead. A preferred thickness of the outer wall 106 would be approximately 0.5 inches with a hardness of from about 40 ksi to about 45 ksi. While certain steels could meet these criteria, a material may be selected by one skilled in the art.

The invention also includes a load bearing support 114 within each cell 109 to provide structural support for the warhead. The load bearing support 114 are placed approximately along the central axis of the warhead. The direction of the stresses/pressures generated in the explosive material 110 during penetration will stiffen the load bearing support, making it stronger, but bulge the outer wall 106. Therefore, making the load bearing support 114 the load bearing component is advantageous. In one embodiment of the invention the load bearing support columns 114 comprise a hardness from about 45 ksi to about 55 ksi. Again, the material may be selected by one skilled in the art. Certain steels may also be used for this purpose. One preferred load bearing support 114 is a support post. To prevent the discs 108 from shearing and sliding axially, the load bearing support 114 may be thickened or flared near the base of each disc. The compartmentalized structure produced above provides high strength and rigidity at minimum structural weight because the load bearing support 114 and cellular structure 104 do not require large thicknesses to resist buckling.

A preferred embodiment of the invention also comprises a ballast 116 in a cavity 105 formed behind the super-cavitating nose 102. The ballast helps provide more target penetration by concentrating missile mass more near the nose 102 of the warhead. Any heavy mass material may be used for the ballast and may be selected by one skilled in the art. One preferred ballast 116 material is depleted uranium.

In another preferred embodiment of the invention, the warhead comprises a length of from about 8 feet to about 16 feet and a diameter of from about 10 inches to about 16 inches.

The initiation means 112 are used to initiate the explosive material 110 when the warhead reaches its target. In a preferred embodiment, the initiation means comprises a fuze 118 located within a tail cell 120 of the warhead, opposite of the nose 102. Buffering materials 122 surround the fuze 118 to protect the it when stresses result from penetration of the warhead. The buffering materials 122 may be selected by one skilled in the art. A central channel 124 is formed within the load bearing support 114 along with a plurality of radial channels 126 extending from the central channel into each cell to transmit the initiation wave to the explosive material 110.

The present invention also includes a method of destroying a hardened or buried target. This method comprises providing the warhead as discussed above, firing the warhead at the hardened or buried target, and, initiating the initiation means. Any of the embodiments of the warhead described above may be used as part of this method.

What is described are specific examples of many possible variations on the same invention and are not intended in a limiting sense. The claimed invention can be practiced using other variations not specifically described above.

What is claimed is:

1. A warhead for penetrating hardened or buried targets, comprising:

a cellular structure, comprising:
- an outer wall;
- a plurality of discs, arranged along a central axis, axially spaced within the outer wall, that forms cells; and,
- a load bearing support, placed along the central axis, integral with each of the discs, to provide structural support for the cellular structure;

a super-cavitating nose for penetrating hardened or buried targets comprising a blunt-rounded shaped tip and an inwardly curved portion forming a shoulder wherein the shoulder pushes target debris away from the outer wall;

a cavity within the super-cavitating nose having a ballast within the cavity;

explosive material within each cell of the cellular structure; and, initiation means for initiating the explosives.

2. The warhead of claim 1, wherein the outer wall comprises a fragmentation wall capable of producing high velocity fragments upon initiation of the explosive material.

3. The warhead of claim 2, wherein the load bearing support comprises a support post having a flared shape proximate to the discs to prevent the discs from shearing.

4. The warhead of claim 3, wherein the initiation means comprises:

a fuze located within a tail cell of the warhead;

buffering materials surrounding the fuze;

a central channel formed within the load bearing support; and, a plurality of radial channels extending from the central channel into each cell to transmit an initiation wave to the explosive material.

5. The warhead of claim 4, wherein the outer wall comprises a thickness of approximately 0.5 inches.

6. The warhead of claim 5, wherein the outer wall comprises a hardness from about 40 ksi to about 45 ksi.

7. The warhead of claim 6, further comprising a length of from about 8 feet to about 16 feet.

8. The warhead of claim 7, further comprising a diameter of from about 10 inches to about 16 inches.

9. The warhead of claim 8, wherein the load bearing support comprises a hardness from about 45 ksi to about 55 ksi.

10. The warhead of claim 9, wherein the ballast comprises depleted uranium.

11. The warhead of claim 10, wherein the super-cavitating nose comprises a hardness from about 55 ksi to about 60 ksi.

12. The warhead of claim 11, wherein the discs comprise a thickness of approximately 1 inch.

* * * * *